US007874422B2

(12) United States Patent
Ishii et al.

(10) Patent No.: US 7,874,422 B2
(45) Date of Patent: Jan. 25, 2011

(54) CIGARETTE BOX AND BLANK THEREFOR

(75) Inventors: Hirobumi Ishii, Tokyo (JP); Tetsuya Nakamura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 327 days.

(21) Appl. No.: 12/073,530

(22) Filed: Mar. 6, 2008

(65) Prior Publication Data

US 2008/0164159 A1 Jul. 10, 2008

Related U.S. Application Data

(63) Continuation of application No. PCT/JP2006/316254, filed on Aug. 18, 2006.

(30) Foreign Application Priority Data

Sep. 8, 2005 (JP) ..... 2005-260662

(51) Int. Cl.

| | |
|---|---|
| ***A24F 15/00*** | (2006.01) |
| ***B65D 85/10*** | (2006.01) |
| ***B65D 5/00*** | (2006.01) |
| ***B65D 5/74*** | (2006.01) |

(52) U.S. Cl. ..... 206/273; 206/264; 229/125.42; 229/128

(58) Field of Classification Search ..... 206/236, 206/242, 249, 254, 259, 264, 271, 273; 229/128, 229/125.42; D27/186, 189

See application file for complete search history.

(56) References Cited

U.S. PATENT DOCUMENTS

| | | | | |
|---|---|---|---|---|
| 1,754,730 | A * | 4/1930 | Van Sickels | 206/273 |
| 1,927,408 | A * | 9/1933 | Lang | 206/264 |
| 2,130,475 | A | 9/1938 | Shouse | |
| 2,202,280 | A | 5/1940 | Wilson | |
| 2,281,058 | A | 4/1942 | Winterbourne | |
| 2,849,154 | A * | 8/1958 | Gartrell et al. | 206/254 |
| 3,190,534 | A | 6/1965 | Tamarin | |
| 3,360,114 | A * | 12/1967 | Blum | 206/268 |
| 3,672,557 | A * | 6/1972 | Krzyzanowski | 229/125.42 |
| 3,998,380 | A * | 12/1976 | Kanelous | 229/229 |
| 4,119,196 | A * | 10/1978 | Flaherty | 206/271 |
| 4,742,955 | A * | 5/1988 | Focke et al. | 206/273 |
| 5,520,196 | A | 5/1996 | Yang | |
| 2004/0011681 | A1 * | 1/2004 | Swart et al. | 206/271 |

FOREIGN PATENT DOCUMENTS

| | | |
|---|---|---|
| EP | 0 950 618 A2 | 10/1999 |

(Continued)

*Primary Examiner*—J. Gregory Pickett
(74) *Attorney, Agent, or Firm*—Birch, Stewart, Kolasch & Birch, LLP

(57) ABSTRACT

A cigarette box has a V-shaped notch (6) cut in an edge of a top wall thereof, a push-pull wall (8) forming one side wall thereof, and a fin-shaped knob (10) provided on the outer surface of the push-pull wall (8). When the push-pull wall (8) is pulled out of the cigarette box, an upper end thereof is shaped like the letter V forming a rhombic opening (12) in cooperation with the notch (6). On the other hand, when the push-pull wall (8) is pushed into the cigarette box, the upper end thereof coincides with the notch (6), forming an oppositely directed V shape and closing the opening (12).

6 Claims, 9 Drawing Sheets

FOREIGN PATENT DOCUMENTS

| | | | |
|---|---|---|---|
| EP | 0950618 | A2 | 10/1999 |
| JP | 47-23332 | | 11/1972 |
| JP | 46-039061 | | 12/1972 |
| JP | 5-213340 | A | 8/1993 |
| JP | 7-194360 | A | 8/1995 |
| JP | 7-194361 | A | 8/1995 |
| JP | 2003-516276 | A | 5/2003 |
| WO | WO 2004/028927 | A1 | 4/2004 |

* cited by examiner

CIGARETTE BOX AND BLANK THEREFOR

This application is a Continuation of co-pending Application No. PCT/JP2006/316254 filed on Aug. 18, 2006, and for which priority is claimed under 35 U.S.C. §120; and this application claims priority of Application No. 2005-260662 filed in Japan on Sep. 8, 2005 under 35 U.S.C. §119; the entire contents of all are hereby incorporated by reference.

TECHNICAL FIELD

The present invention relates to a cigarette box which is used to contain an inner pack including a bundle of filter cigarettes or cigarettes and a wrapper wrapping the bundle therein, and a blank for the cigarette box.

BACKGROUND ART

As such cigarette boxes, so-called hinged-lid packages are widely used. A hinged-lid package has a box body and a lid for opening and closing the box body, as disclosed in Unexamined Japanese Patent Publication No. H05-213340, for example, and an inner pack is contained in the box body.

This form of package has long been familiar to ordinary people including smokers. Accordingly, such packages have no newness in their manner of being opened and closed and have little visual appeal for users to arouse their interest.

An object of the present invention is therefore to provide a cigarette box which is so novel in its manner of being opened and closed as to induce users to buy, and a blank for the cigarette box.

DISCLOSURE OF THE INVENTION

To achieve the object, a cigarette box according to the present invention comprises a box body containing an inner pack including a bundle of cigarettes and a wrapper wrapping the bundle therein. The box body includes a push-pull wall forming one side wall of the box body and capable of being pulled out of and pushed into the box body, the push-pull wall creating an opening in an upper surface of the box body when the push-pull wall is pulled outward to one side of the box body, the opening being closed when the push-pull wall is pushed in and sunk into the box body; and a fin-shaped knob provided on an outer surface of the push-pull wall and extending in a longitudinal direction of the push-pull wall, the knob being sunk into the box body, together with the push-pull wall, when the push-pull wall is pushed into the box body.

With the cigarette box constructed as above, the user picks the knob with his/her fingers and then pulls the push-pull wall outward to one side of the cigarette box. Pulling the push-pull wall outward in this manner is accompanied by the creation of the opening in the top wall of the box body, thus allowing the user to take a filter cigarette or cigarette out of the inner pack through the opening. As the user pushes the push-pull wall, together with the knob, into the cigarette box, the opening closes.

The cigarette box greatly differs from ordinary hinged-lid packages in the manner of being opened and closed and also has such a novel external appearance as to arouse users' interest.

Specifically, the box body further includes a V-shaped notch cut in one side edge of its top wall, and the push-pull wall has a folding line located at the center thereof and extending in the longitudinal direction. When pulled out of the box body, the push-pull wall is bent outward, or mountain-folded, along the folding line, forming a V shape directed oppositely to the notch. In this case, the push-pull wall forms a rhombic opening in cooperation with the notch. On the other hand, when pushed into the box body, the push-pull wall is bent inward, or valley-folded, along the folding line, forming a V shape directed in the same direction as the notch.

The knob preferably extends along the folding line over an entire length of the push-pull wall. Preferably, moreover, the push-pull wall has a pair of triangular bottoms at its lower end. The triangular bottoms form extended parts of the bottom wall of the box body when the push-pull wall is pulled out of the box body.

The box body may be made up of two parts, namely, an inner case and an outer case. The inner case holds the inner pack such that the upper surface of the inner pack is exposed, and has the push-pull wall and the knob. The outer case accommodates the inner case such that the push-pull wall and the knob are exposed, and has the notch in the top wall thereof.

Preferably, the inner and outer cases are constructed such that when the push-pull wall is pulled out of and pushed into the box body, the inner case is allowed to move, together with the push-pull wall, in the pull and push directions relative to the outer case.

The present invention also provides a blank for the cigarette box and a blank for the inner case. The blanks will become apparent from the following description of the best mode when taken in conjunction with the accompanying drawings.

BEST MODE OF CARRYING OUT THE INVENTION

Figure 1:
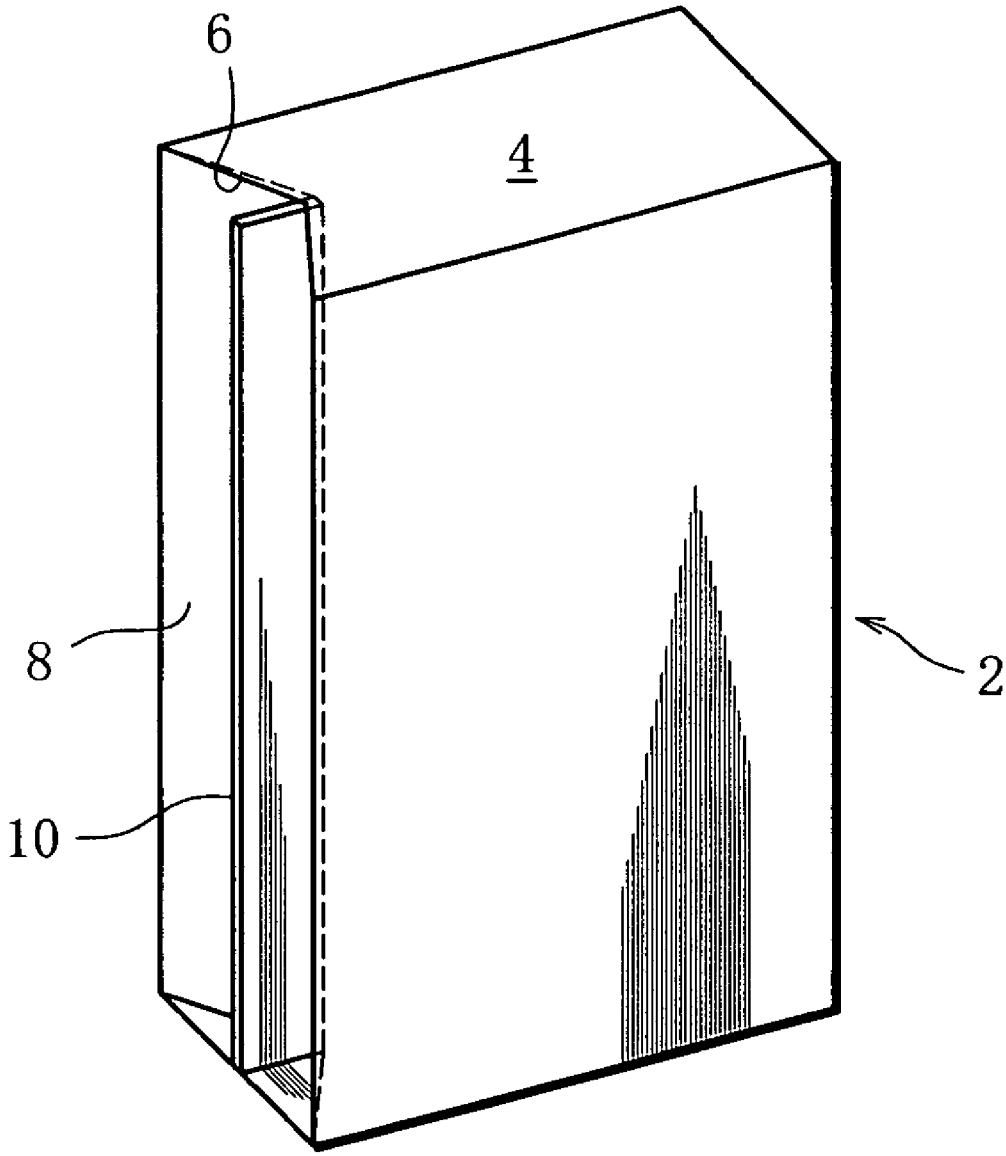
FIG. 1 is a perspective view showing a closed state of a cigarette box according to a first embodiment.
Figure 2:
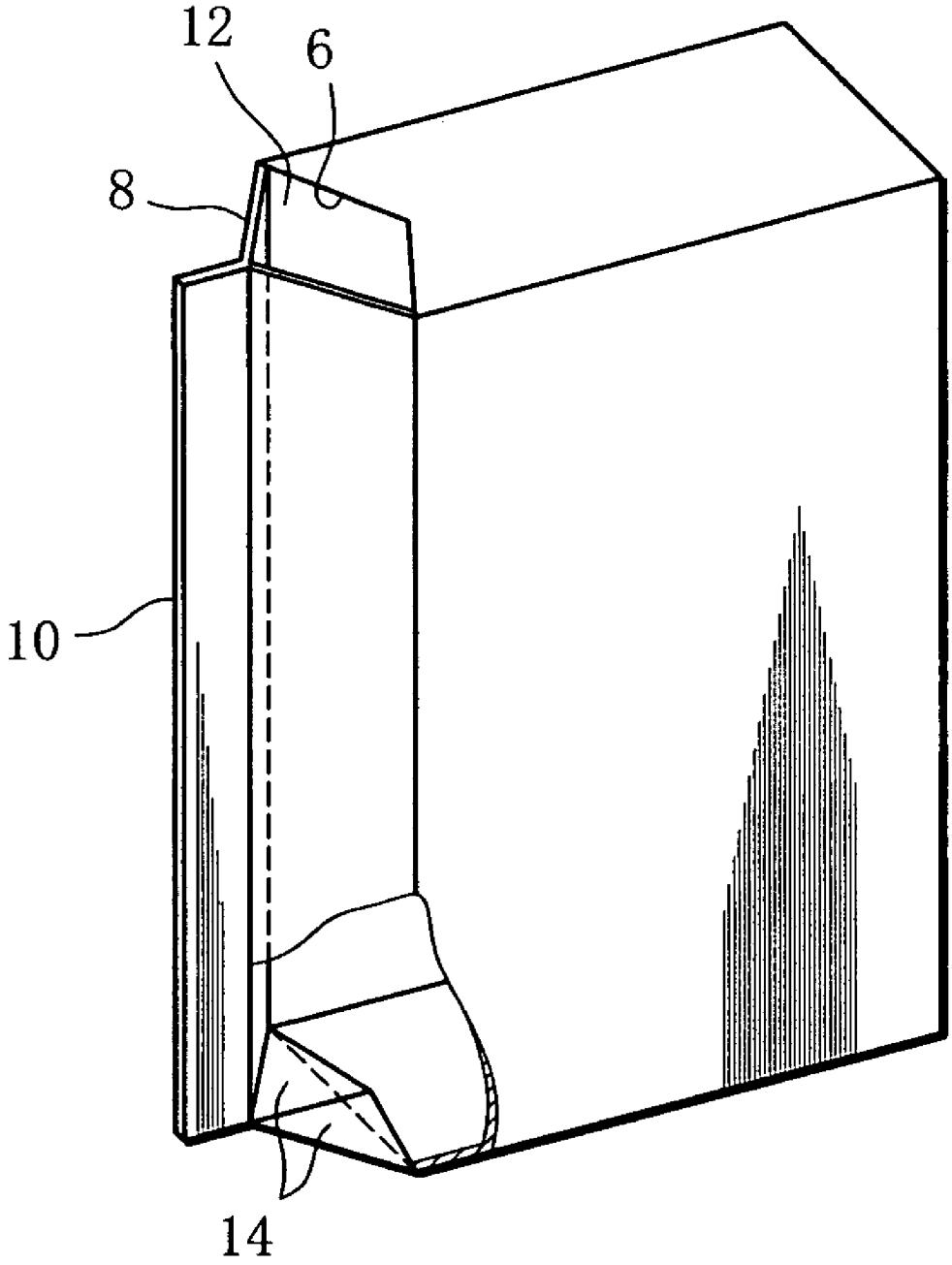
FIG. 2 is a partly cutaway perspective view of the cigarette box of FIG. 1.

FIGS. 1 and 2 illustrate a cigarette box according to a first embodiment.

The cigarette box includes a box body 2 nearly in the form of a rectangular parallelepiped, and an inner pack contained in the box body 2. The inner pack includes a bundle of filter cigarettes or cigarettes, and a wrapper wrapping the bundle therein. In FIGS. 1 and 2, the inner pack is not illustrated. The cigarette box is wrapped in a transparent film (not shown) having a tear tape.

The box body 2 has a rectangular top wall 4, and a V-shaped notch 6 is cut in one side edge of the top wall 4. A side wall of the box body 2 located on the same side as the notch 6 is formed as a push-pull wall 8. Specifically, the push-pull wall 8 extends along the longitudinal axis of the box body 2 and has a fin-shaped knob 10 located at the center thereof. The knob 10 projects from the push-pull wall 8 to one side of the box body 2 and extends over the entire length of the push-pull wall 8.

FIG. 1 illustrates a closed state of the box body 2 wherein the push-pull wall 8 is pushed into the box body 2. While in this state, the push-pull wall 8 is shaped like the letter V projecting toward the inside of the box body 2 and the knob 10 is located in the V-shaped space defined by the push-pull wall 8. Accordingly, when the box body 2 is closed, the V-shaped upper end of the push-pull wall 8 meets the V-shaped notch 6, as clearly shown in FIG. 1. Namely, the inner pack has a width shorter than that of the box body 2 so as to spare an internal space permitting the push-pull wall 8 to be pushed into the box body 2.

When the push-pull wall 8 is pulled out by the user to one side of the box body 2 with the knob 10 picked between his/her fingers, the push-pull wall 8 is shaped like the letter V projecting to the outside of the box body, that is, the letter V directed oppositely to the notch 6, as shown in FIG. 2. Accordingly, the V-shaped upper end of the push-pull wall 8 forms a rhombic opening 12 in cooperation with the V-shaped notch 6, thus opening the box body 2. A filter cigarette or cigarette of the inner pack can therefore be taken out of the box body 2 through the opening 12.

The push-pull wall 8 is thereafter pushed in toward the notch 6, whereupon the push-pull wall 8 and the notch 6 are restored to the state shown in FIG. 1, so that the opening 12 is closed.

As is clear from the above, the V shape of the push-pull wall 8 reverses as the wall 8 is pulled out and pushed in. Specifically, when the push-pull wall 8 is pushed in, the wall 8 is shaped like a valley-folded V with the base of the fin-shaped knob 10 serving as the valley floor. On the other hand, when the push-pull wall 8 is pulled out, the wall 8 is shaped like a mountain-folded V with the base of the knob 10 serving as the mountaintop.

As shown in FIG. 2, the push-pull wall 8 further includes a pair of triangular bottoms 14 at its lower end. The triangular bottoms 14 are associated with the respective two sides of the V-shaped push-pull wall 8 and project toward the inside of the box body 2 in parallel with the bottom wall of the body 2. When the push-pull wall 8 is pushed into the box body 2, therefore, the triangular bottoms 14 are lapped over the bottom wall of the box body 2. On the other hand, when the push-pull wall 8 is pulled out of the box body 2, the triangular bottoms 14 project from the box body 2 together with the push-pull wall 8 and form extended parts of the bottom wall of the box body 2.

With the above cigarette box of the first embodiment, the push-pull wall 8 is pulled out of and pushed into the box body 2 by the user with the fin-shaped knob 10 picked between his/her fingers, to open and close the box body 2. The box body 2 is unique in its manner of being opened and closed and also the push-pull wall 8 with the fin-shaped knob 10 imparts a novel external appearance to the cigarette box, inducing users to buy the cigarette box of the present invention.

Figure 3:
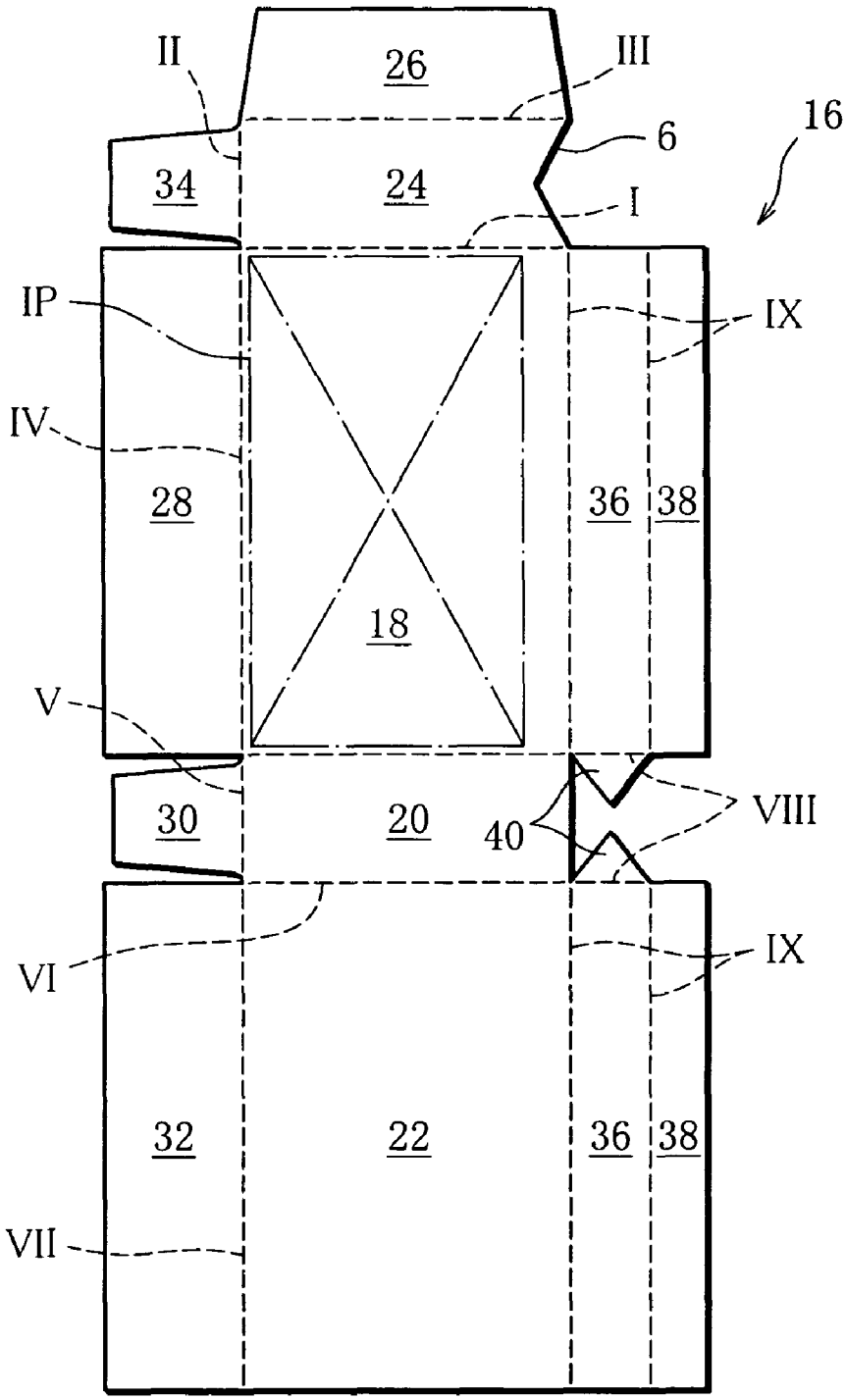
FIG. 3 shows a blank for forming the cigarette box of FIG. 1.

The cigarette box of FIGS. 1 and 2 is formed by folding a blank 16 shown in FIG. 3. FIG. 3 shows the inside of the blank 16.

The blank 16 includes panels and flaps. Adjacent panels, adjacent flaps, and panels and their adjacent flaps are demarcated by folding lines indicated by the broken lines in FIG. 3.

Specifically, the blank 16 has a rear panel 18 at its center. On the lower side of the rear panel 18 as viewed in FIG. 3, a bottom panel 20 and a front panel 22 are connected in order. On the upper side of the rear panel 18, a top panel 24 and an inner front flap 26 are connected in the order mentioned. These panels 18, 20, 22 and 24 are arranged in a line along the longitudinal axis of the blank 16 and respectively constitute the rear wall, bottom wall, front wall and top wall 4 of the box body 2. The V-shaped notch 6 is therefore cut in one side edge of the top panel 24 which is to form the top wall 4. The inner front flap 26 serves as a reinforcing member for the front wall of the box body 2.

The rear panel 18, the bottom panel 20, the front panel 22 and the top panel 24 are connected, at their side edges opposite the notch 6, with an inner side flap 28, an inner bottom flap 30, an outer side flap 32 and a top end flap 34, respectively. The inner and outer side flaps 28 and 32 constitute one side wall of the box body 2, and the inner bottom flap 30 serves as a reinforcing member for the bottom wall of the box body 2. The top end flap 34 serves as a reinforcing member for the one side wall of the box body 2.

The rear and front panels 18 and 22 are connected at their other side edges with outer side flaps 36, respectively, and fin flaps 38 are connected to the respective outer side flaps 36. Triangular flaps 40 are connected to the lower edge of the upper outer side flap 36 and the upper edge of the lower outer side flap 36, respectively, as viewed in FIG. 3, and extend from their respective flaps 36 toward each other. The upper and lower outer side flaps 36 form the push-pull wall 8, and the upper and lower fin flaps 38 form the knob 10. The triangular flaps 40 constitute the respective triangular bottoms 14.

In FIG. 3, reference numerals I to IX associated with the respective folding lines indicated by the broken lines show a procedure for folding the blank 16. Prior to the folding of the blank 16, glue is applied to predetermined regions of the panels and flaps, and then the inner pack IP, indicated by the dot-dash lines, is placed on and bonded to the rear panel 18 of the blank 16. As clearly shown in FIG. 3, one side surface of the inner pack IP is located along the folding line between the rear panel 18 and the inner side flap 28, but the other side surface of the inner pack IP is spaced at a predetermined distance from the folding line between the rear panel 18 and the outer side flap 36.

Figure 4:
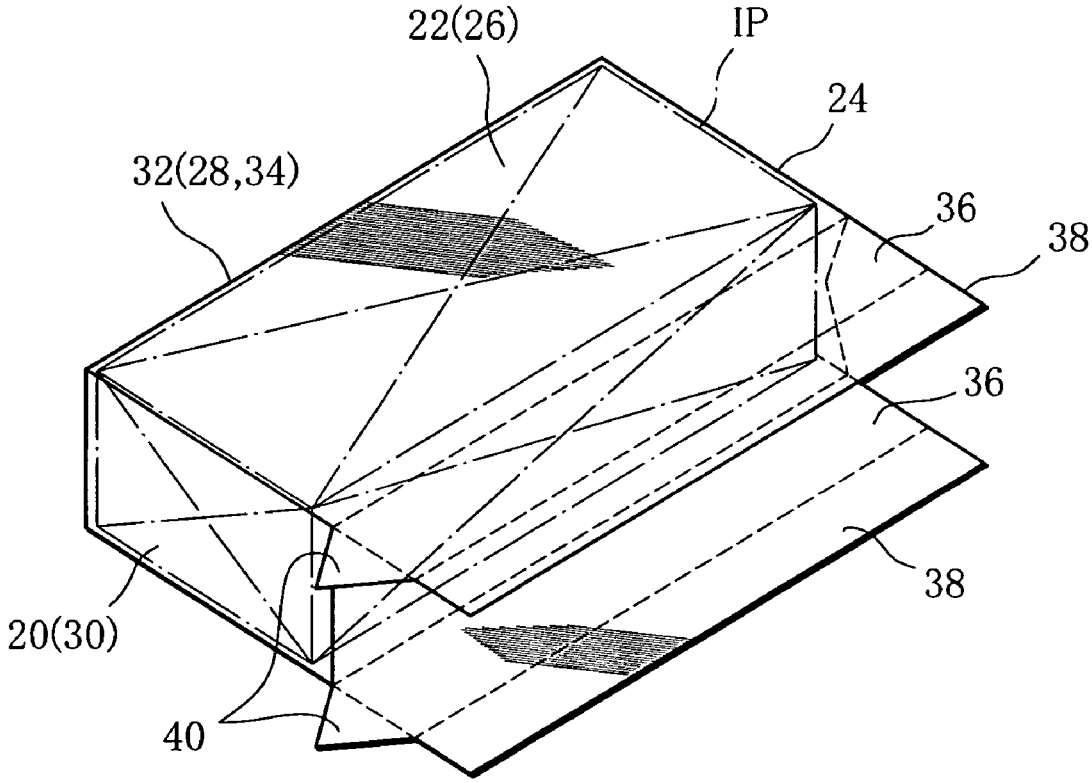
FIG. 4 is a perspective view showing the manner of how the blank of FIG. 3 is folded.

The blank 16 in the state shown in FIG. 3 is then folded around the inner pack IP, in the order indicated by I to VII, along the respective folding lines, thus obtaining an intermediate product, or the cigarette box shown in FIG. 4. As is clear from FIG. 4, the cigarette box as the intermediate product is in a state such that the outer side flaps 36 connected to the rear and front panels 18 and 22, respectively, project sideways from the inner pack IP, together with the fin flaps 38 and the triangular flaps 40.

Figure 5:
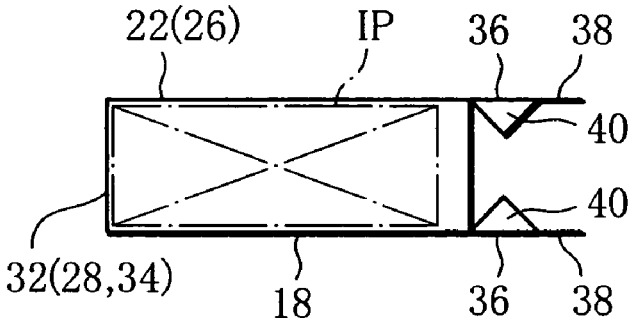
FIG. 5 illustrates a blank folded state after the state shown in FIG. 4.
Figure 6:
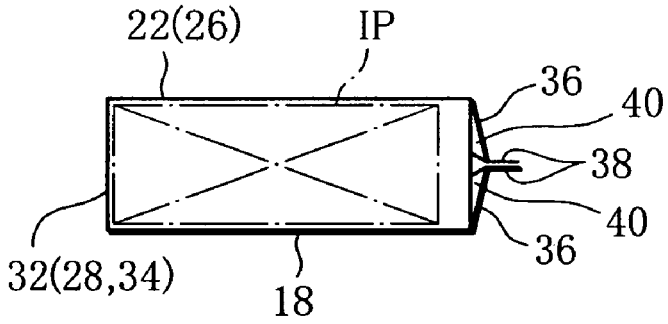
FIG. 6 illustrates a blank folded state after the state shown in FIG. 5.
Figure 7:
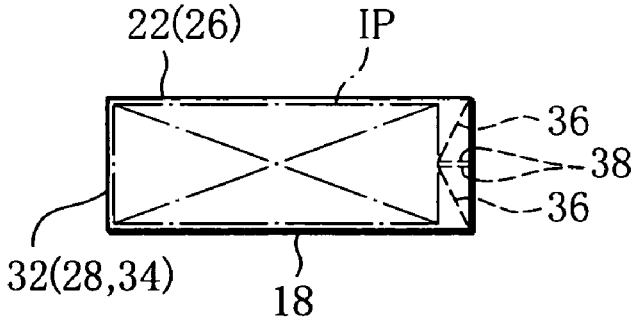
FIG. 7 illustrates a blank folded state after the state shown in FIG. 6.

Subsequently, the upper and lower triangular flaps 40 in the state shown in FIG. 4 are turned in toward each other (cf. VIII in FIG. 3), so that the triangular flaps 40 are located closer to each other, as shown in FIG. 5. The upper and lower fin flaps 38 are then valley-folded (cf. IX in FIG. 3) along the respective folding lines demarcating the fin flaps 38 and their corresponding outer side flaps 36. Namely, the upper and lower fin flaps 38 are folded so as to approach each other. The thus-folded fin flaps 38 are lapped over and bonded to each other, thus forming the fin-shaped knob 10. Simultaneously with the formation of the knob 10, the upper and lower outer side flaps 36 are also turned in (cf. IX in FIG. 3), as shown in FIG. 6, so that the outer side flaps 36 form the push-pull wall 8. The knob 10 and the push-pull wall 8 are then pushed toward the inner pack IP, thus obtaining the closed cigarette box shown in FIG. 7 (corresponding to the cigarette box shown in FIG. 1).

Figure 8:
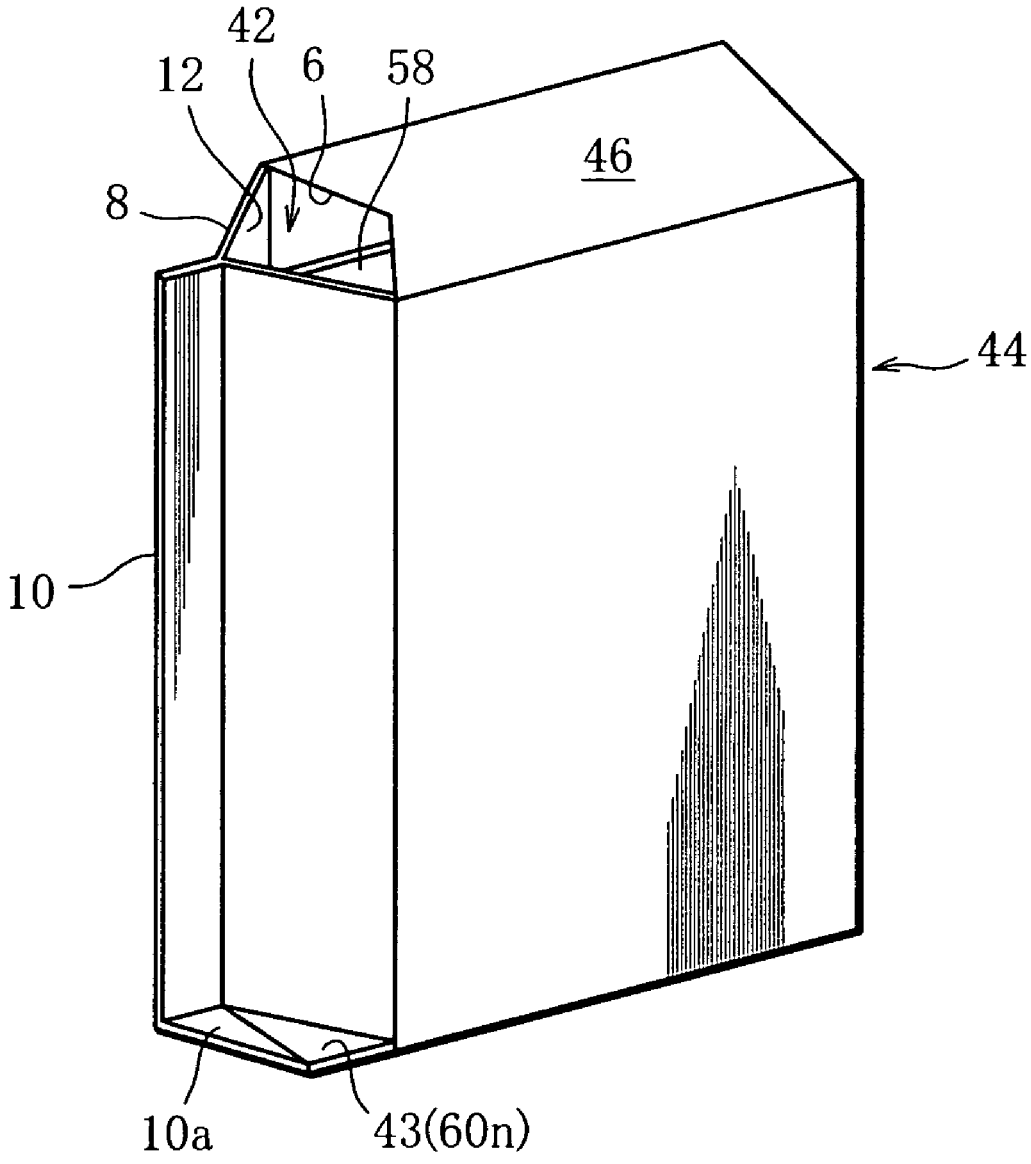
FIG. 8 is a perspective view showing an open state of a cigarette box according to a second embodiment.

FIG. 8 illustrates a cigarette box according to a second embodiment.

The cigarette box of FIG. 8 has a box body with a double structure comprising an inner case 42 and an outer case 44. The inner case 42 holds the inner pack IP therein and has the aforementioned fin-shaped knob 10 and push-pull wall 8. The knob 10 has a pair of triangular legs 10*a* at its lower end, and the legs 10*a* are lapped over the bottom wall 43 of the inner case 42. The triangular legs 10*a* and the bottom wall 43 will be described in more detail later.

The outer case 44 surrounds the inner case 42, except for the push-pull wall 8 and the knob 10, and has the V-shaped notch 6 cut in its top wall 46.

The cigarette box of the second embodiment is opened and closed in a manner similar to that of the cigarette box of the first embodiment and also has an external appearance similar to that of the first embodiment.

Figure 9:
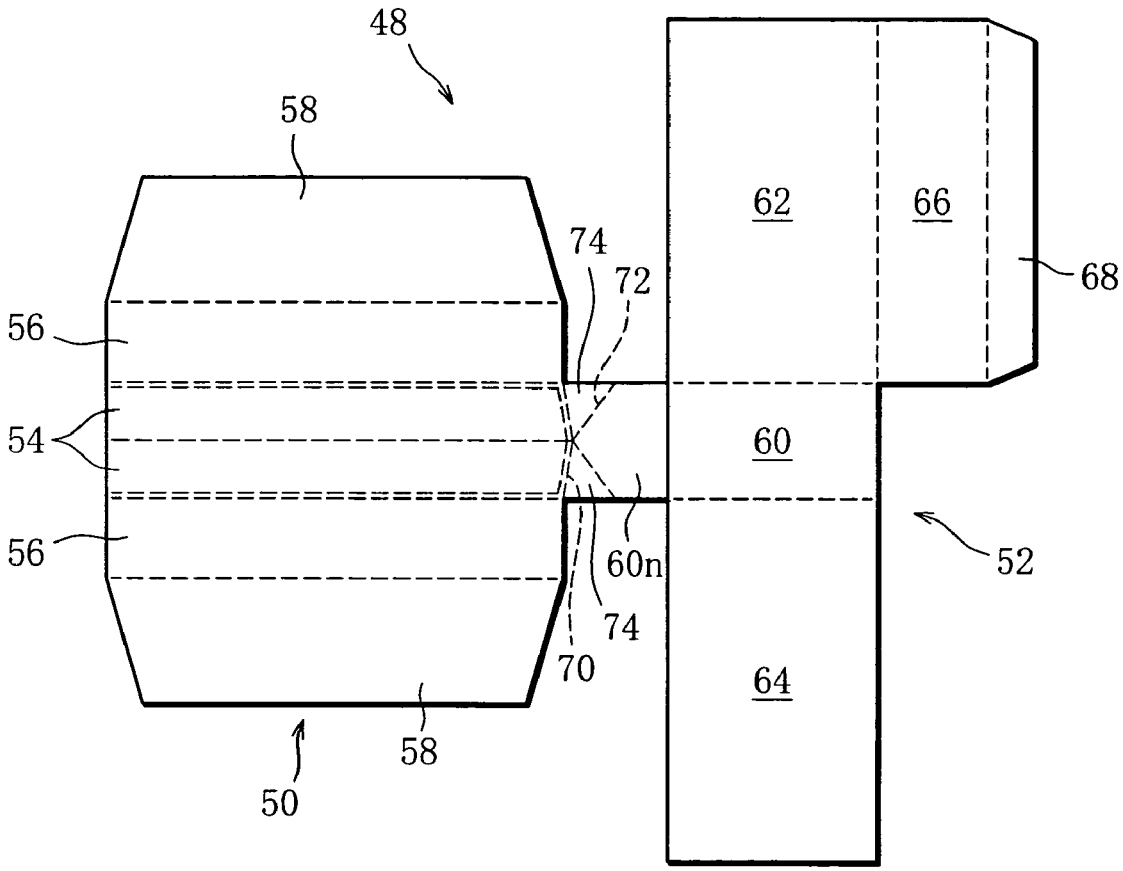
FIG. 9 shows a blank for forming an inner case of the cigarette box of FIG. 8.

The inner case 42 is formed by folding a blank 48 shown in FIG. 9. The blank 48 includes panels and flaps. Adjacent panels, adjacent flaps, and panels and their adjacent flaps are demarcated by folding lines indicated by the broken lines in FIG. 9. FIG. 9 shows the inside of the blank 48.

More specifically, the blank 48 is divided into first and second sections 50 and 52. The first section 50 forms the push-pull wall 8 and the knob 10, while the second section 52 forms an inner frame for holding the inner pack IP.

The first section 50 has a pair of center panels 54 at its center, and the center panels 54 are marked off from each other by a folding line. The upper center panel 54 is connected at its upper edge, as viewed in FIG. 9, with an outer panel 56, and also the lower center panel 54 is connected at its lower edge with an outer panel 56. The folding line marking each center panel 54 off from the corresponding outer panel 56 is indicated by a double broken line. The pair of center panels 54 form the fin-shaped knob 10, and the pair of outer panels 56 form the push-pull wall 8.

Further, each outer panel 56 is connected with a connection flap 58. The outer panels 56 and their corresponding connection flaps 58 are demarcated by respective folding lines. Accordingly, the panels and flaps of the first section 50 are arranged symmetrically with respect to the center folding line of the section 50, as is clear from FIG. 9.

The second section 52 has a bottom panel 60 at its center, and the bottom panel 60 is connected at its upper and lower edges with rear and front panels 62 and 64, respectively. The panels 60, 62 and 64 constitute the bottom wall 43, rear wall and front wall of the inner case 42, respectively.

As clearly shown in FIG. 9, the bottom panel 60 extends from the rear and front panels 62 and 64 to the first section 50 and is connected to the pair of center panels 54 of the first section 50. Namely, the extended part of the bottom panel 60 serves as a neck 60*n* connecting between the first and second sections 50 and 52. The pair of center panels 54 have an overall width $W_1$ (distance between the two double broken lines) equal to the width $W_2$ of the neck 60*n*.

The rear panel 62 is connected, at its side edge located opposite the first section 50, with a side panel 66 and further with a joint flap 68. The side panel 66 forms a side wall of the inner case 42, and the joint flap 68 is used to connect the side panel 66 to the front panel 64.

The boundary between the first section 50 and the neck 60*n* is demarcated by a folding line 70 which is in the form of a flattened V directed toward the neck 60*n*. Also, the neck 60*n* has a folding line 72 which has its vertex adjoining the vertex of the folding line 70 and which is in the form of the letter V directed oppositely to the folding line 70. Accordingly, the neck 60*n* has two triangular regions 74 demarcated between the folding lines 70 and 72 and constituting the aforementioned triangular legs 10*a* (see FIG. 8).

In connection with the folding of the blank 48, the single broken lines in FIG. 9 each indicate a folding line for a mountain fold and the double broken lines each indicate a folding line for a valley fold. Also, before the blank 48 is folded up, glue is applied to predetermined regions on the inside of the blank 48.

The folding of the blank 48 is started from the neck 60*n* of the bottom panel 60 of the second section 52 and the first section 50. Specifically, the neck 60*n* is mountain-folded along the V-shaped folding line 72, and simultaneously with this, the first section 50 is valley-folded along the V-shaped folding line 70. As a result of the mountain- and valley-folding, the first section 50 is raised upright relative to the second section 52 with the pair of triangular regions 74 lapped over the neck 60*n*, thus forming the aforementioned pair of triangular legs 10*a*.

Figure 10:
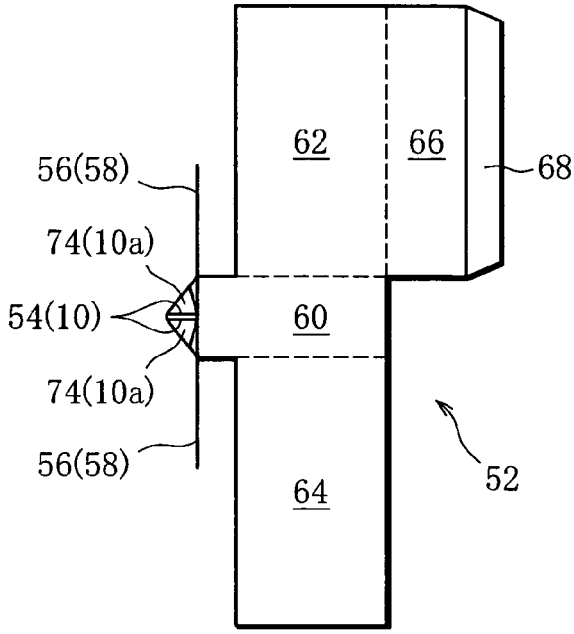
FIG. 10 illustrates the manner of how the blank of FIG. 9 is folded.

Also, at the same time that the first section 50 is raised upright, the first section 50 is mountain-folded along the folding line between the pair of center panels 54, so that the two center panels 54 are lapped over each other. The thus-lapped center panels 54 are bonded to each other to form the aforementioned knob 10, and at this stage the knob 10 extends upward from the triangular legs 10*a*, as shown in FIG. 10. At this time, the pair of outer panels 56 each provided with the connection flap 58 are folded outward to be located on both sides of the knob 10.

Figure 11:
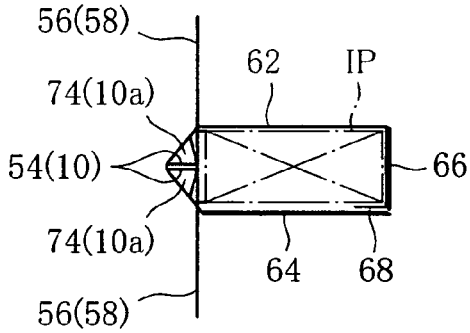
FIG. 11 illustrates a blank folded state after the state shown in FIG. 10.

Subsequently, as shown in FIG. 11, the inner pack IP is placed on the bottom panel 60 such that the bottom surface of the inner pack IP is in contact with the bottom panel 60. The rear panel 62, the side panel 66 and the joint flap 68 are then successively folded around the inner pack IP, and the front panel 64 is folded toward the inner pack IP and lapped over the joint flap 68. The front panel 64 and the joint flap 68 are bonded to each other. At this stage, the inner pack IP is surrounded, except for its upper surface, by the panels and flaps of the first and second sections 50 and 52.

Figure 12:
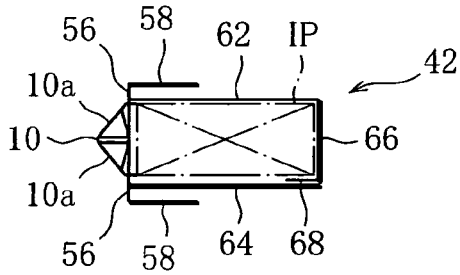
FIG. 12 illustrates a blank folded state after the state shown in FIG. 11.
Figure 13:
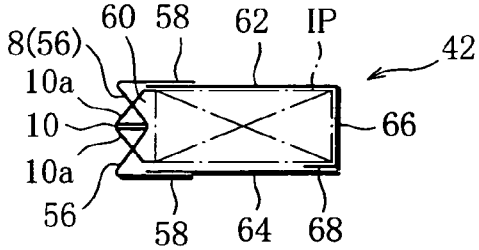
FIG. 13 illustrates a blank folded state after the state shown in FIG. 12.

Then, as shown in FIG. 12, the pair of connection flaps 58 of the first section 50 are mountain-folded toward the inner pack IP along the respective folding lines between the connection flaps 58 and their corresponding outer flaps 56. At the same time that the connection flaps 58 are mountain-folded, the outer panels 56 are individually valley-folded along the respective folding lines between the outer panels 56 and their corresponding center panels 54. As a result, the pair of connection flaps 58 are respectively lapped over the rear and front panels 62 and 64 already folded, as shown in FIG. 13, and the valley-folded outer panels 56 form the V-shaped push-pull wall 8, thus completing the formation of the inner case 42.

It is to be noted here that the pair of connection flaps 58 are not bonded to the respective rear and front panels 62 and 64. Thus, provided the connection flaps 58 are fixed, pushing in and pulling out the push-pull wall 8 cause the inner case 42 to move back and forth, together with the inner pack IP, along the connection flaps 58.

Figure 14:
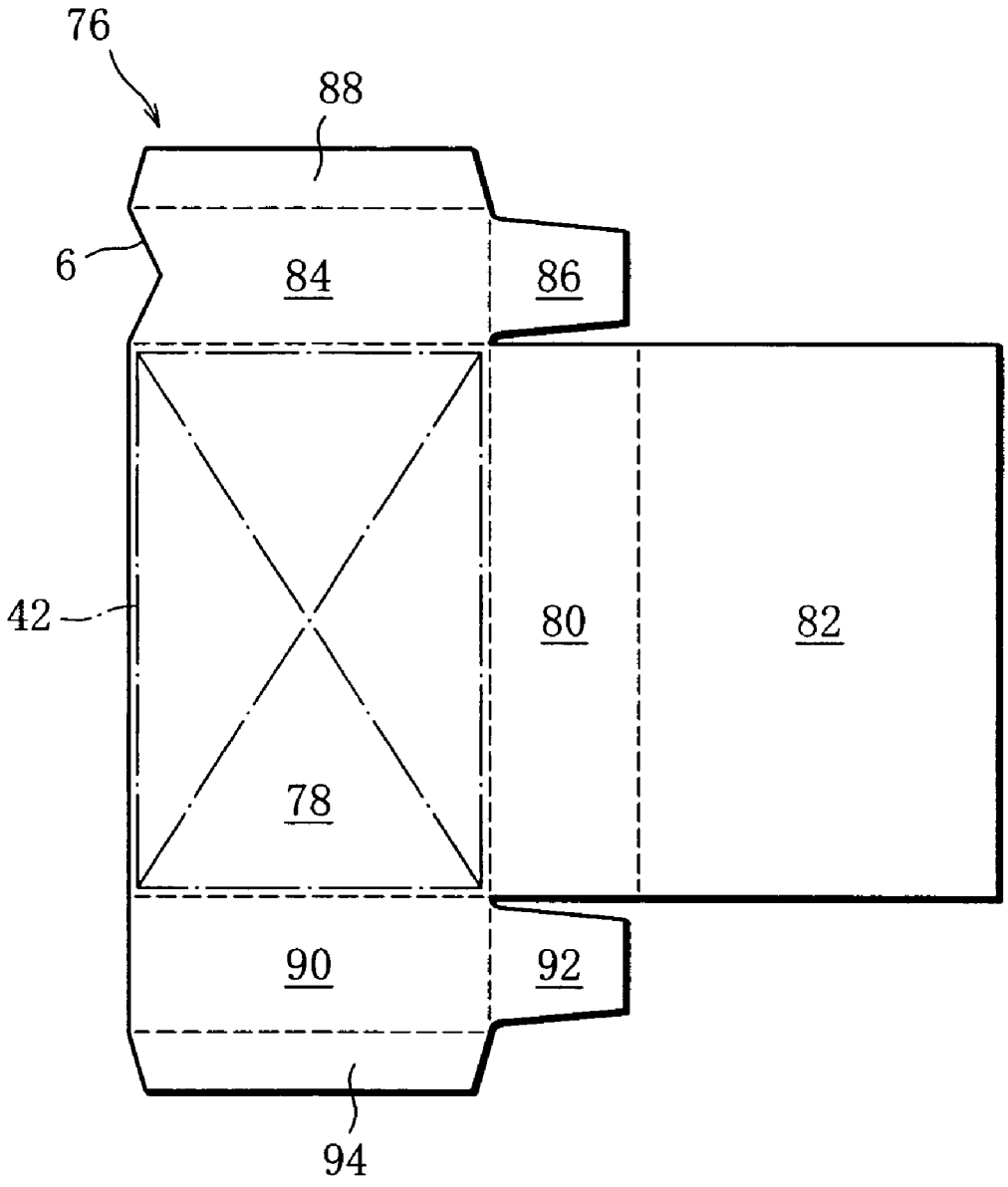
FIG. 14 shows a blank for forming an outer case of the cigarette box of FIG. 8.

FIG. 14 shows a blank 76 for forming the outer case 44. The blank 76 also includes panels and flaps. Adjacent panels, adjacent flaps, and panels and their adjacent flaps are demarcated by folding lines indicated by the broken lines in the figure.

More specifically, the blank 76 has a rear panel 78, to one side edge of which a side panel 80 and a front panel 82 are successively connected. Also, a top panel 84 is connected to the upper edge of the rear panel 78. The top panel 84 has the notch 6 cut in one side edge thereof located opposite the side panel 80, and has a top end flap 86 connected to the other side edge thereof. Further, a joint flap 88 is connected to the upper edge of the top panel 84.

The rear panel 78 is also connected at its lower edge with a bottom panel 90. The bottom panel 90 has a bottom end flap 92 and a joint flap 94.

The blank 76 of FIG. 14 is folded around the aforementioned inner case 42 to form the cigarette box shown in FIG. 8. Prior to the folding of the blank 76, glue is applied to predetermined regions on the inside of the blank 76.

First, as shown in FIG. 14, the inner case 42 is placed on the rear panel 78. At this time, the inner case 42 is positioned such that the push-pull wall 8 is located on the same side as the notch 6, and the corresponding connection flap 58 of the inner case 42 is lapped over and bonded to the rear panel 78.

Subsequently, the top panel 84 is folded toward and lapped over the upper surface of the inner pack IP contained in the inner case 42. Also, at the same time that the top panel 84 is folded, the bottom panel 90 is folded toward and lapped over the bottom wall (bottom panel 60) of the inner case 42. Then, the top and bottom end flaps 86 and 92 are individually folded toward and lapped over the corresponding side wall (side panel 66) of the inner case 42. Further, the joint flaps 88 and 94 are folded toward and lapped over the front wall (front panel 64) of the inner case 42.

The side panel 80 is then folded toward and lapped over the corresponding side wall of the inner case 42. Consequently, the flaps 86 and 92 are interposed between the side wall of the inner case 42 and the side panel 80.

Further, the front panel 82 is folded toward and lapped over the front wall of the inner case 42. Accordingly, the flaps 88 and 94 are interposed between the inner case 42 and the front panel 82. The flaps 88 and 94 are bonded to the front panel 82, and the front panel 82 is bonded to the other connection flap 58 of the inner case 42, whereupon the formation of the outer case 44, namely, the cigarette box shown in FIG. 8, is finished.

The inner case 42 is fixed to the outer case 44 only by the pair of connection flaps 58. Accordingly, as the user pulls the push-pull wall 8 out of the outer case 44 with the knob 10 picked between his/her fingers, the push-pull wall 8 is deformed into an outward convex V shape, as shown in FIG. 8, thus forming the rhombic opening 12 in cooperation with the notch 6 of the outer case 44.

When the push-pull wall 8 is pulled outward, the inner case 42, together with the inner pack IP, moves relative to the outer case 44. Consequently, part of the bottom wall of the inner case 42, that is, the neck 60*n* of the bottom panel 60, projects from the outer case 44.

On the other hand, when the push-pull wall 8 is pushed into the outer case 44, the notch 6 of the outer case 44 is closed and the inner case 42 is completely sunk into the outer case 44, together with the push-pull wall 8 and the knob 10.

In order to facilitate the folding of the blank 48 along the folding lines 70 and 72, each of the folding lines 70 and 72 may be formed as a row of perforations, instead of an indentation line commonly used.

The invention claimed is:

1. A cigarette box comprising:

a box body including:

a push-pull wall forming one side wall of the box body and capable of being pulled out of and pushed into the box body, the push-pull wall creating an opening in an upper surface of the box body when the push-pull wall is pulled outward to one side of the box body, the opening being closed when the push-pull wall is pushed in and sunk into the box body, a fin-shaped knob provided on an outer surface of the push-pull wall and extending in a longitudinal direction of the push-pull wall, the knob being sunk into the box body, together with the push-pull wall, when the push-pull wall is pushed into the box body, a V shaped notch cut in one side edge of a top wall thereof;

said push-pull wall having a folding line located at a center thereof and extending in the longitudinal direction;

wherein when pulled out of the box body, the push-pull wall is bent outward along the folding line, forming a V shape directed oppositely to the notch, and when pushed into the box body, the push-pull wall is bent inward along the folding line, forming a V shape directed in a direction identical with that of the notch;

an inner case holding an inner pack such that an upper surface of the inner pack is exposed, and having the push-pull wall and the knob; and an outer case accommodating the inner case such that the push-pull wall and the knob are exposed, and having the notch cut in a top wall thereof.

2. The cigarette box according to claim 1, wherein the knob extends along the folding line over an entire length of the push-pull wall.

3. The cigarette box according to claim 1, wherein the push-pull wall has a pair of triangular bottoms at a lower end thereof, the triangular bottoms forming extended parts of a bottom wall of the box body when the push-pull wall is pulled out of the box body.

4. The cigarette box according to claim 1, wherein, when the push-pull wall is pulled out of and pushed into the box body, the inner case is allowed to move, together with the push-pull wall, in the pull and push directions relative to the outer case.

5. A blank set for forming a cigarette box of claim 1, comprising:

an inner blank comprising:

a bottom wall formed by a bottom panel, a front panel and a rear panel;

a center panel having a first end connected to a neck, said neck being connected to a first end of the bottom panel, said center panel being divided into two parts a first outer panel connected to a first side of the center panel;

a second outer panel connected to a second side of the center panel;

a first connection flap connected to an outer side of the first outer panel and extending outwardly therefrom;

a second connection flap connected to an outer side of the second outer panel and extending outwardly therefrom;

a side panel having a first end connected to a side edge of the rear panel;

a joint flap connected to a second end of the side panel opposite to the first end of the side panel; and wherein the bottom wall and the center panel are connected via a V shaped folding line and a pair of triangular regions extend towards the bottom panel from the center panel; and the center panel folds up inwardly along the V shaped folding line wherein the triangular regions overlap the neck forming a pair of triangular legs;

an outer blank comprising:

an outer rear panel;

an outer side panel having a first end connected to a first end of the outer rear panel;

an outer front panel having a first end connected to a second end of the outer side panel;

an outer top panel having a first end connected to a top of the outer rear panel, the outer top panel having a notch forming a V shaped notch on the cigarette box, the outer top panel having a top end flap extending to the side of the outer top panel and a joint flap extending from an upper edge of the outer top panel; and an outer bottom panel having a first end connected to a bottom of the outer rear panel, the outer bottom panel having a bottom end flap extending to the side from the outer bottom panel and a joint flap extending from a bottom edge of the outer bottom panel;

wherein the outer top, bottom, front, side and rear panels forming a top, bottom, front, side and rear wall of the cigarette box.

6. A blank for forming a cigarette box including a box body comprising:

a push-pull wall forming one side wall of the box body and capable of being pulled out of and pushed into the box body, the push-pull wall creating an opening in an upper surface of the box body when the push-pull wall is pulled outward to one side of the box body, the opening being closed when the push-pull wall is pushed in and sunk into the box body, and a fin-shaped knob provided on an outer surface of the push-pull wall and extending in a longitudinal direction of the push-pull wall, the knob being sunk into the box body, together with the push-pull wall, when the push-pull wall is pushed into the box body, a V shaped notch cut in one side edge of a top wall thereof;

said push-pull wall having a folding line located at a center thereof and extending in the longitudinal direction;

wherein when pulled out of the box body, the push-pull wall is bent outward along the folding line, forming a V shape directed oppositely to the notch, and when pushed into the box body, the push-pull wall is bent inward along the folding line, forming a V shape directed in a direction identical with that of the notch; the blank comprising:

a longitudinal axis;

rear, bottom and front panels for forming rear, bottom and front walls of the box, respectively, the rear, bottom and front panels being arranged in a line along the longitudinal axis, adjacent ones of the panels being demarcated by a folding line;

an inner side flap connected via a folding line to one side edge of the rear panel;

an outer side flap connected via a folding line to one side edge of the front panel located on a side identical with the inner side flap, for forming one side wall of the box in cooperation with the inner side flap;

a top panel connected via a folding line to one edge of the rear panel located opposite the bottom panel, for forming a top wall of the box, the top panel having a V-shaped notch in a side edge thereof located opposite the side flaps;

a first half side flap connected via a folding line to an opposite side edge of the rear panel;

a first fin flap connected via a folding line to an outer side edge of the first half side flap;

a second half side flap connected via a folding line to an opposite side edge of the front panel; and a second fin flap connected via a folding line to an outer side edge of the second half side flap, wherein the first and second fin flaps are lapped over each other to form the fin-shaped knob, and the first and second half side flaps are in contact with each other at the outer side edges thereof to form the V-shaped push-pull wall.

* * * * *